United States Patent [19]

Chrastina

[11] 4,185,264

[45] Jan. 22, 1980

[54] WIRE GUIDE AND METHOD FOR PRECONDITIONING BOUYANT ELECTRODES

[75] Inventor: William Chrastina, Panama City, Fla.

[73] Assignee: The United States of America as represented by the Secretary of the Navy, Washington, D.C.

[21] Appl. No.: 955,725

[22] Filed: Oct. 26, 1978

[51] Int. Cl.[2] ..... B63B 21/56; H01B 7/12

[52] U.S. Cl. ..... 340/852; 114/253; 114/244; 174/101.5

[58] Field of Search ..... 340/3 T, 4 E; 174/69, 174/99 E, 101.5; 114/244, 247, 253

[56] References Cited

U.S. PATENT DOCUMENTS

| | | | |
|---|---|---|---|
| 3,940,732 | 2/1976 | Hudson et al. | 340/4 E |
| 4,117,447 | 9/1978 | Gould et al. | 340/4 E |

*Primary Examiner*—Richard A. Farley

*Attorney, Agent, or Firm*—Richard S. Sciascia; Harvey A. David

[57] ABSTRACT

Preconditioning of towable, flexible electrodes having a conductive layer consisting wires helically laid on a bouyant core, to preclude later birdnesting, is accomplished using a flange device having cylindrical mounting portions fixed to the aft end of the core and radially extending flange portions having a circular pattern of guide holes through which aft end portions of the wires pass loosely. The guide holes have their axes disposed at predetermined pitch and convergence angles.

13 Claims, 4 Drawing Figures

WIRE GUIDE AND METHOD FOR PRECONDITIONING BOUYANT ELECTRODES

BACKGROUND OF THE INVENTION

This invention relates to bouyant, towed electrodes of the cable type such as are used for sweeping of magnetic influence mines, and more particularly to a novel wire guide device and method for preconditioning such electrodes.

U.S. Pat. No. 3,940,732, issued to J. A. Hudson and M. J. Yelverton and assigned to the assignee hereof, describes a bouyant electrode of a cable type that is towed-along its axial length, by a helicopter for example, at substantial speeds through sea water. The electrode is energized to produce electrical currents in the sea water. Magnetic disturbances resulting from the electrical currents and the forward motion of the electrode are effective in sweeping magnetic influence mines. The electrode of that patent comprises a core or central strength member in the form of a synthetic filament rope, a cylindrical bouyant sleeve of a closed cell plastic foam material and an outer conductive layer formed of helically wound strands of aluminum wire. The aluminum wire strands are tightly bound with an aluminum wire serving in the forward portion of the electrode, and the forward end of the electrode is provided with a conductive metal lug or connector that is swaged or otherwise fixed to the strength member and provides for electrical connection to the serving and to the helical wires of the electrode. At the aft end of the electrode, the helical wires are bound to the bouyant sleeve by one or more metal bands, preferably of the screw tightened variety.

While the aforedescribed prior art electrode has many advantages, it has been found that it suffers one disadvantage in that excess aluminum wire is unavoidably distributed along the length of the electrode during the helical winding thereof and, during use, the excess tends to work its way along the electrode and accumulates at the aft end. The accumulation presents itself as a balooning out or enlargement in the wire layer resembling a bird nest just ahead of the band clamping the wire ends. In view of this, it has been the practice to precondition each electrode by towing it for a period of time until the bird's nest is formed, then removing the band clamp, manually cutting off the excess wire of each strand, re-shaping the end portions of the wire to the bouyant sleeve, and reclamping. Even with such preconditioning, there remains a tendency for the problem to repeat itself, possibly because as the bird's nest grows it becomes self-limiting in the amount of slack that can be pulled out of the helical wire winding by the hydrodynamic forces acting on the wire and the bird's nest.

U.S. patent application Ser. No. 828,714 filed Aug. 29, 1977, now U.S. Pat No. 4,117,447, and assigned to the assignee hereof, describes an electrode cable having an anti-birdnesting device in the form of a slide element that is key for axial movement along the aft end of the bouyant sleeve, and to which the wire ends are clamped. That device is intended to allow slack in the winding to work its way aft of the cable without generating a birds nest, and represents one useful approach to the problem of excess wire in the cable windings. It is, however, subject to disadvantages of requiring moving parts that are subject to possible binding and breakage under severe conditions of use.

SUMMARY OF THE INVENTION

The present invention aims to overcome the foregoing problems and shortcomings of the wire wound towable electrodes through the provision and use of a novel wire guide device that permits more effective and complete electrode preconditioning, whereby substantially all of the slack in the wire winding is removed and subsequent formation of bird's nests is unlikely.

With the foregoing in mind, it is a principal object of the invention to provide a wire guide device that can be secured to the aft end of the bouyant sleeve of an electrode to be preconditioned, and which allows the slack or excess wire to accumulate beyond that aft end without forming a bird's nest, and with the individual wires in position for final clamping.

Another object of the invention is the provision of a device of the foregoing character that places an added drag on the end of the electrode to ensure that any kinks, bends or twists will be drawn and worked out of the electrode during its preconditioning towing.

Still another object is the provision of a device and method for producing improved wire wound electrodes of the towed, bouyant cable type.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
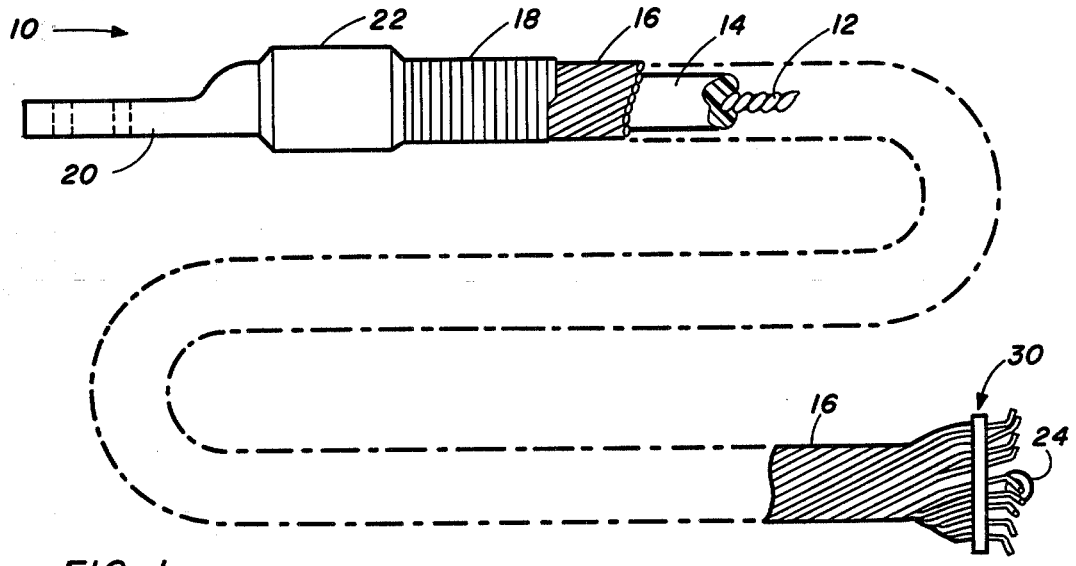
FIG. 1 is an elevational view of an electrode and wire guide device embodying this invention.

Referring to FIG. 1, a flexible, bouyant, cable type of electrode that is ready for preconditioning using the device and method of this invention is indicated generally at 10 and comprises a central strength member 12, a core in the form of a cylindrical sleeve 14 of bouyant plastic material surrounding the strength member, a layer 16 of helically laid aluminum wire strands, a wire serving 18, and a forward end connector 20. Additionally, the electrode 10 conveniently comprises a molded synthetic rubber collar 22, and at the aft end is provided with a terminal end connector eye or loop 24 that is fixed to the strength member 12.

Thus far, the general construction of the electrode 10 is similar to that of the electrode described in the mentioned U.S. Pat. No. 3,940,732, to which reference may be had for details relating to the manner in which the parts thus far named are made and assembled.

Figure 2:
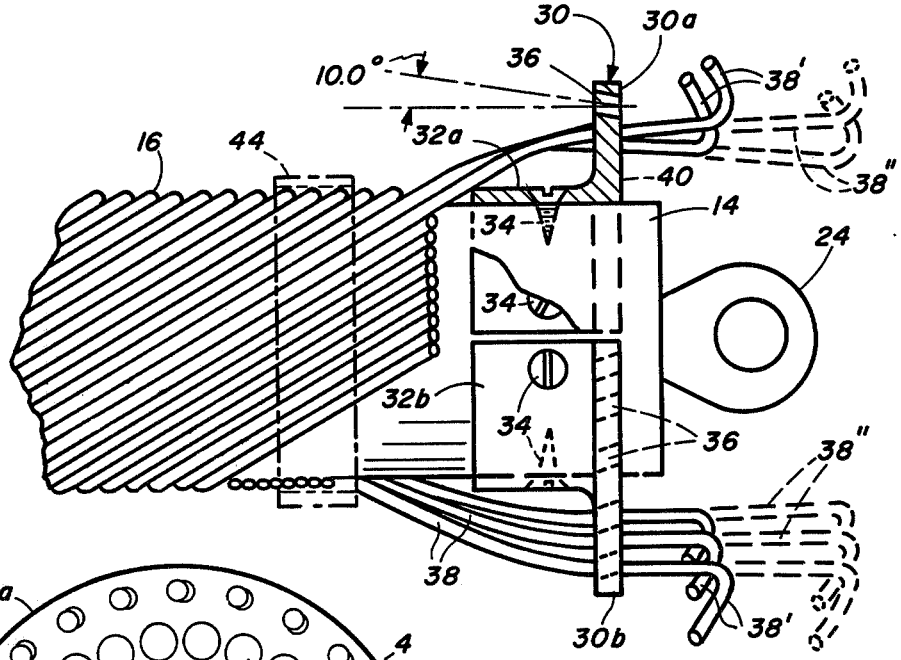
FIG. 2 is an enlarged fragmentary view, partly in section, of the aft end portion of the electrode and the wire guide device of FIG. 1.
Figure 3:
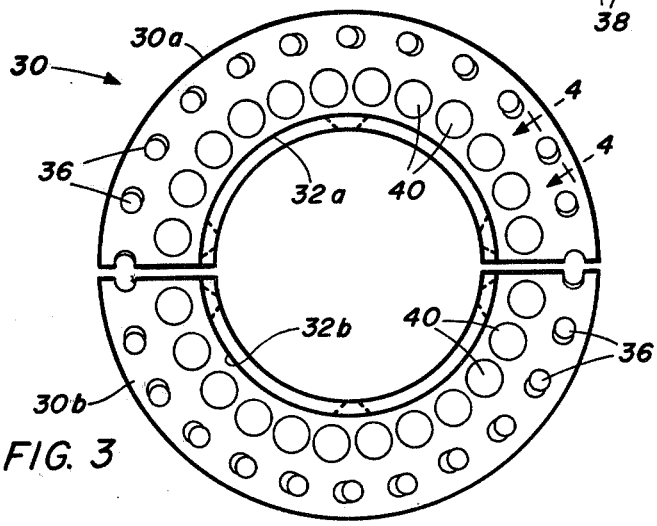
FIG. 3 is an end elevational view of the wire guide device.

In accordance with this invention, and with reference additionally to FIGS. 2 and 3, a circular wire guide device, generally indicated at 30, comprises a plurality of rigid flange sections in the form of a pair of radially extending half-flanges 30*a* and 30*b* that have semi-cylindrical, axially extending mounting portions 32*a* and 32*b*, respectively. The semi-cylindrical portions 32*a*, 32*b* are adapted to be fixed about the terminal end of the bouyant sleeve 14 of the electrode 10 by screws 34.

Figure 4:
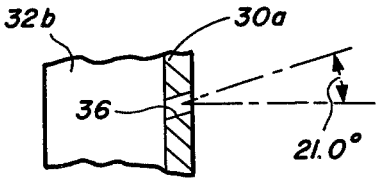
FIG. 4 is a fragmentary sectional view taken substantially along line 4—4 of FIG. 3.

The half-flanges 30*a*, 30*b* are provided with a series of holes or openings 36 disposed in a circle and equal in number to the number of wires 38 in the outer helical layer 16. In this exemplary embodiment the wires 38 and openings 36 each total 24 in number. The openings 36, through each of which a corresponding one of the wires 38 is led, are drilled or otherwise formed with the hole axes at predetermined angles relative to the normal to the broad surfaces of the flange halves 30*a*, 30*b*. These angles provide 10° of convergence toward the axis of the electrode aft of the flange halves, as shown in FIG. 2, and 21° of pitch as shown in FIG. 4. The openings 36 are each of a diameter that will allow one of the wires 38 to slide loosely therethrough.

The flange-halves 30*a*, 30*b* are further provided with an inner circle of holes or openings 40 which serve to lighten the device 30 and control the amount of hydrodynamic drag imposed by the device on the electrode 10 when towed with the device in place for preconditioning of the electrode.

In assembling the flange-halves 30*a*, 30*b* to the electrode 10, the free ends of the individual wires 38 of the layer 16 are introduced into respective ones of the angular holes 36 and the flange halves moved forwardly into the positions illustrated in FIG. 2. They are then secured to the bouyant sleeve 14 by the screws 34 through openings in the semi-cylindrical mounting portions which have an inside diameter substantially equal to the outside diameter of the bouyant sleeve to which they are secured.

The end portions of the wires 38, exposed to the rear of the flange-halves 30*a*, 30*b*, are then bent radially outwardly as shown at 38′ in FIG. 2. The electrode 10 and guide device 30 are then ready for preconditioning towing behind a ship or other suitable towing platform.

As the electrode is towed through the water, the hydrodynamic actions of the water on the wires 38 of layer 16, and particularly on the hooked ends 38′ cause any slack in the wire layer 16 to be removed and the excess wire to pass through the guide device 30 without forming a bird's nest. The bent wire ends therefore move aft as shown in dot and dash lines at 38″ in FIG. 2. The wires 38 are maintained in their helical lay because the device 30 prevents any unwrapping or unwinding of the layer 16 while permitting the slack to be worked aft.

When the preconditioning tow is completed and the electrode retrieved, a band clamp 44 is applied just forward of the guide device 30. The wires 38 are then severed aft of the device 30 to remove the excess wire, and the flange-halves 30*a*, 30*b* removed. A second band clamp (not shown) is then applied adjacent the end of the core 14, clamping the wires 38 of layer 16.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. In combination with a flexible electrode adapted to be towed along its long axis, said electrode having forward and aft ends, a strength member, a bouyant sleeve surrounding said strength member, and a layer of helically laid wire strands fixed to the forward end of and covering said sleeve, a wire guide device comprising:

flange means fixed to said bouyant sleeve and extending radially therefrom substantially at the aft end of said electrode;

said flange means characterized by a plurality of wire guide openings extending therethrough and arranged in a circular pattern about said bouyant sleeve and substantially concentric therewith; and said openings loosely passing the aft end portions of corresponding ones of said wire strands, whereby when said electrode is towed, excess wire in said helical layer works its way aft and through said wire guide openings while said guide device prevents unwrapping of said layer.

2. The combination defined in claim 1, and wherein said wire guide device comprises a plurality of flange sections.

3. The combination as defined in claim 1, and wherein said wire guide device comprises a plurality of flange sections, each having a cylindrical mounting portion adapted to engage said bouyant sleeve.

4. The combination defined in claim 1, and wherein said wire guide openings are characterized by hole axes disposed at predetermined pitch angles substantially corresponding to the pitch of said helically laid wire strands.

5. The combination as defined in claim 3, and wherein said wire guide openings are characterized by hole axes disposed at predetermined pitch angles substantially corresponding to the pitch of said helically laid wire strands.

6. The combination as defined in claim 5, and wherein said guide openings are further characterized by said hole axes having predetermined convergence angles.

7. The combination as defined in claim 6, and wherein said flange sections are further characterized by a plurality of drag control openings.

8. A wire guide device for use in preconditioning flexible electrodes of the type having a plurality of helically laid wires forming a layer over a cylindrical core, and wire guide device comprising:

a pair of flange halves each comprising a radially extending semi-circular flange portion and an axially extending semi-cylindrical mounting portion;

said flange portions adapted to lie in a common plane and together characterized by a circular pattern of guide holes equal in number to said plurality of wires of the electrodes with which said devide is to be used;

said guide holes being sized to loosely pass corresponding ones of said wires.

9. A wire guide device as defined in claim 8, and wherein said guide holes are characterized by axes disposed at predetermined pitch angles.

10. A wire guide device as defined in claim 9, and wherein said guide holes are characterized by axes disposed at predetermined convergence angles.

11. A method of preconditioning a towable, flexible electrode having a conductive layer formed by a plurality of helically laid wires on a cylindrical core and fixed thereto at the forward end of the electrode, said method comprising the steps of:

fixing to the aft end of said core a radially extending flange having openings therethrough in a circular pattern about the electrode axis, with the aft end portions of said wires extending through said openings;

towing said electrode endwise in water so that excess wire in said layer works aft through said openings;

severing said excess wire from said wires;

removing said flange; and clamping the aft end portions of said wires to said core.

12. The method defined in claim 11, and further characterized by the step of bending the ends of portions of said wires extending aft of said flange radially outwardly prior to said step of towing.

13. The method defined in claim 12, and wherein said openings in said flange are characterized by hole axes that are disposed at predetermined pitch angles.

* * * * *